US005684760A

United States Patent [19]

Hunter

[11] Patent Number: 5,684,760

[45] Date of Patent: Nov. 4, 1997

[54] CIRCUIT ARRANGEMENT FOR MEASURING A TIME INTERVAL

[75] Inventor: Nicholas John Hunter, Lincoln, United Kingdom

[73] Assignee: Plessey Semiconductors, Ltd., United Kingdom

[21] Appl. No.: 566,858

[22] Filed: Dec. 4, 1995

[30] Foreign Application Priority Data

Dec. 16, 1994 [GB] United Kingdom ..... 9425431

[51] Int. Cl.[6] ..... G04F 8/00

[52] U.S. Cl. ..... 368/120

[58] Field of Search ..... 368/113, 120

[56] References Cited

U.S. PATENT DOCUMENTS 4,433,919 2/1984 Hoppe ..... 368/120

4,439,046 3/1984 Hoppe ..... 368/120

4,516,861 5/1985 Fren et al. ..... 368/120

4,875,201 10/1989 Dalzell ..... 368/120

FOREIGN PATENT DOCUMENTS 508232 3/1992 European Pat. Off. .

*Primary Examiner*—Vit W. Miska

*Attorney, Agent, or Firm*—Kirschstein, et al.

[57] ABSTRACT

A circuit arrangement for measuring a time interval by evaluating the number of complete cycles, and/or the fraction of a cycle, of a ring oscillator that occur(s) during the time interval to be measured, in which there are provided means to avoid a count ambiguity if the time interval ends at or about the completion of a cycle of the ring oscillator.

2 Claims, 2 Drawing Sheets

CIRCUIT ARRANGEMENT FOR MEASURING A TIME INTERVAL

The present invention relates to circuit arrangements for measuring time intervals, and in particular for measuring time intervals down to the order of hundreds of picoseconds.

Circuit arrangements are known, for example from European published patent applications Nos. EP-300,757and EP-508,232, in which ring oscillators comprising tapped delay lines or chains of bistable stages are enabled at the commencement of a time interval to be measured, indicated by the leading edge of a pulse signal of a duration representing the time interval, the number of complete cycles of operation and the phase or state of the ring oscillator at the end of the time interval, indicated by the trailing edge of the pulse signal, being taken as the measure of the time interval. Such an arrangement can be calibrated by using one or more reference pulses of known duration. The state of the ring oscillator may for example be latched into a plurality of latches, one for each tap on the delay line or for each of the chain of stages of the oscillator, at the end of the pulse signal, while the number of cycles of operation may be registered in a high frequency counter counting pulses from the last tap or stage of the ring oscillator. The oscillator may have, say, ten taps or stages.

In such an arrangement a problem arises if the end of the enabling pulse signal coincides with the point at which the high frequency counter is about to be docked, when the counter may be clocked to indicate the completion of a cycle of operation while the value held in the latches may still indicate a count of nine, or the counter may not be clocked but the latches indicate a count of ten (or zero). This is because the trailing edge of the enabling pulse is used on the one hand to clock a latch and on the other as a data value, and the circuit responses can vary with operating conditions. In European published application No. EP-508,232, this problem is overcome by using two separate counters clocked from different stages of the ring oscillator.

According to the present invention in a circuit arrangement for measuring a time interval which may be defined by transitions between logic signal levels of an input signal to said arrangement, one of which logic signal levels constitutes an enabling signal level for said circuit arrangement, including a ring oscillator comprising a plurality of stages, a like plurality of latches associated one with each of said stages, and counter means for counting complete cycles of said ring oscillator, there are provided means responsive to the logic signal level of said input signal and to output signal pulses from said ring oscillator to apply said output pulses to said counter means and to give an indication whether a transition in said input signal from said enabling signal level occurs before or after a predetermined transition in said output signal pulses from said ring oscillator.

A circuit arrangement for measuring time intervals, the arrangement being in accordance with the present invention, will now be described by way of example with reference to the accompanying drawings, of which:

Figure 1:
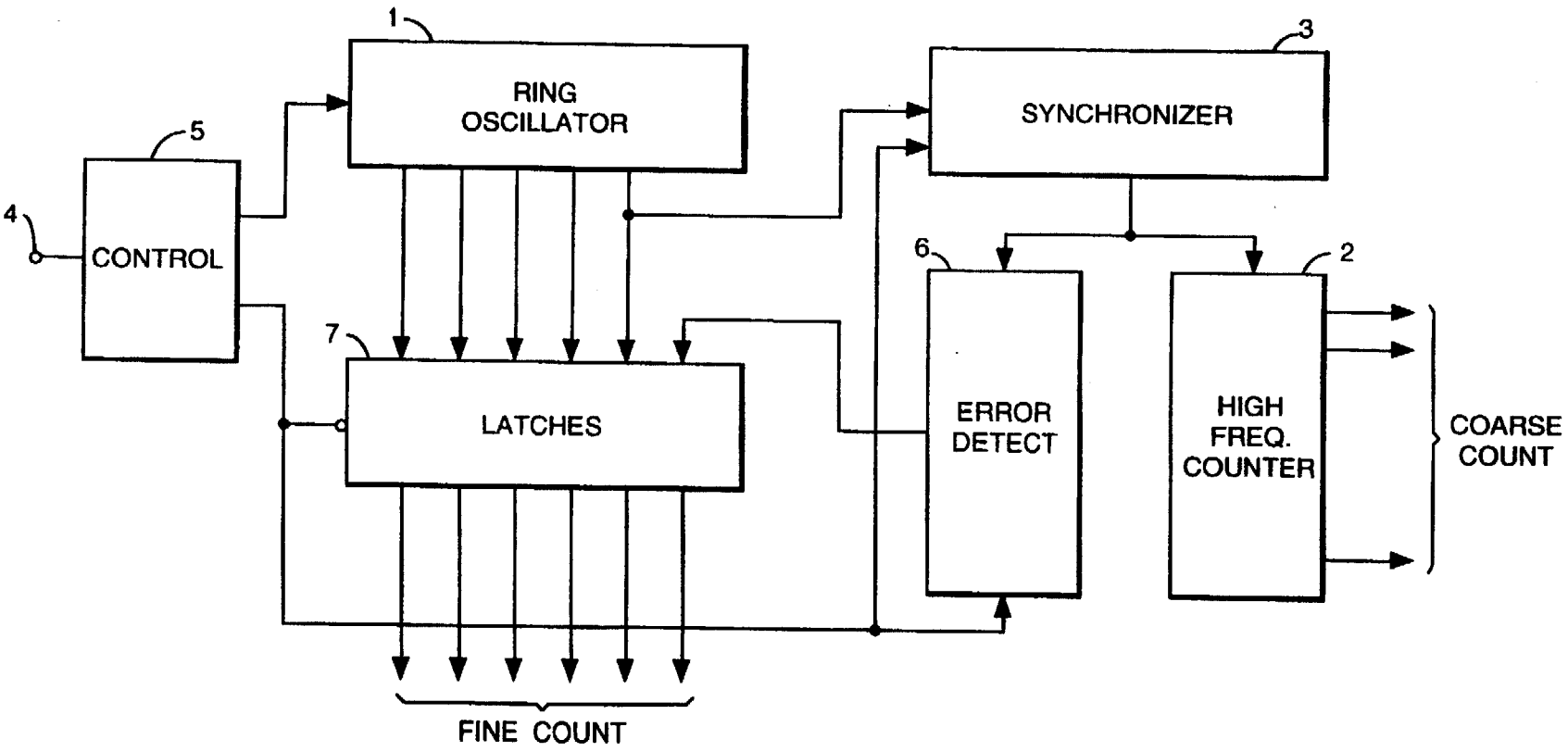
FIG. 1 shows the circuit arrangement schematically.

Referring first to FIG. 1, the circuit arrangement comprises a ring oscillator 1 comprising ten stages (not shown) through which a binary value may propagate with a delay per stage of, say, one hundred picoseconds, such that while the oscillator 1 is enabled it provides an output pulse to a high frequency counter 2 by way of a synchronizer circuit 3 every nanosecond.

An input pulse signal the period of which represents a time interval to be measured is applied by way of an input terminal 4 to a control circuit 5, which at the commencement or leading edge of the input pulse signal applies an enable logic signal level to the synchronizer circuit 3 and to an error detecting circuit 6, and applies the inverse of that enable logic signal level to a set of latches 7 associated with respective stages of the ring oscillator 1. At the same time the ring oscillator 1 is initiallised and set to operate.

At the termination of the input pulse signal the enable logic signal level is removed from the synchronizer 3 and the error detecting circuit 6, and the state of the ring oscillator 1 is arranged to be latched into the latches 7. A "coarse" value for the length of the time interval to be measured is then available from the count registered by the counter 2, while a "fine" value of a fraction of a ring oscillator period may be derived from the latches 7, for example by way of a look-up calibration table (not shown).

Figure 2:
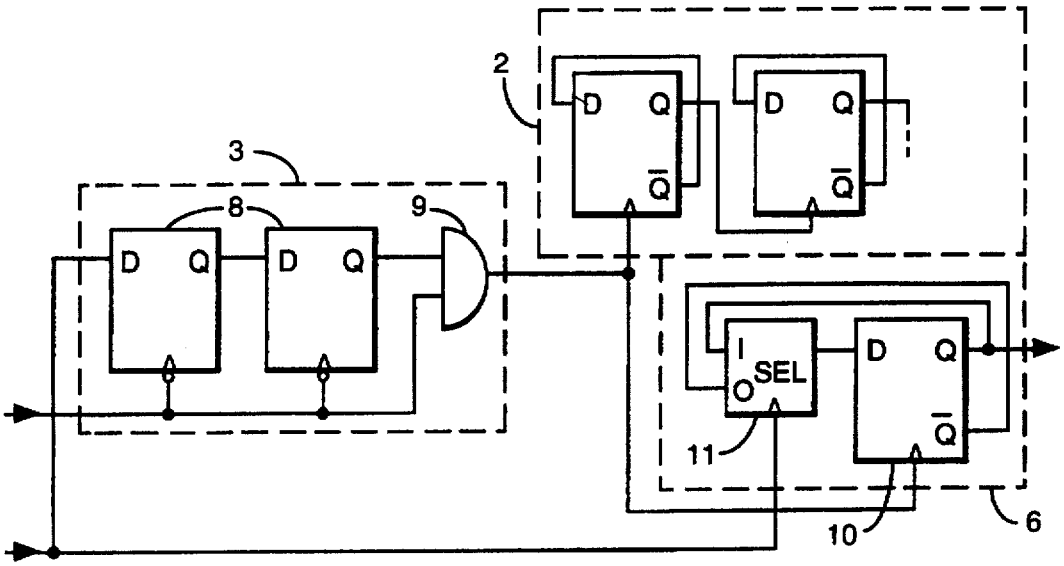
FIG. 2 shows part of the circuit arrangement of FIG. 1 in greater detail.

Referring now to FIG. 2 the synchronizer circuit 3 comprises two D-type flip flops 8, through which the enable logic signal level is clocked by output pulses from the ring oscillator 1, and an AND gate 9 the output of which is connected to clock the first stage of the counter 2 and to the clock input of a D-type flip flop 10 in the error detecting circuit 6. The enable logic signal level is also applied to a select circuit 11 of the error detecting circuit 6.

Figure 3A:
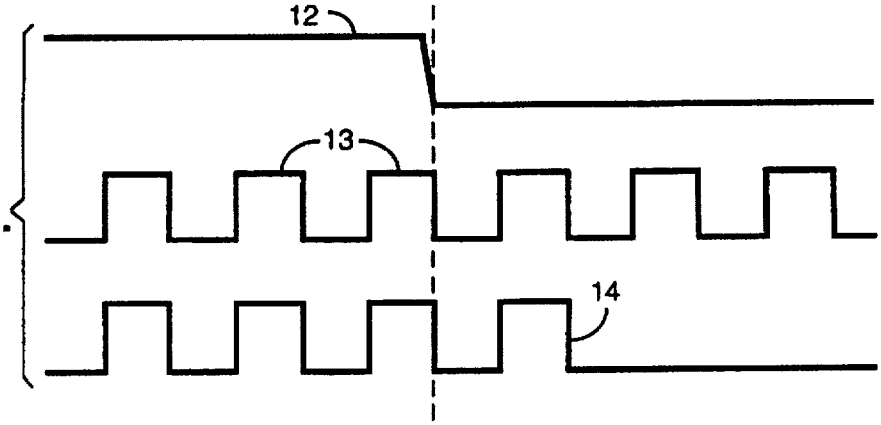
FIG. 3(*a–b*) shows signal waveforms illustrating the operation of the circuit arrangement.
Figure 3B:
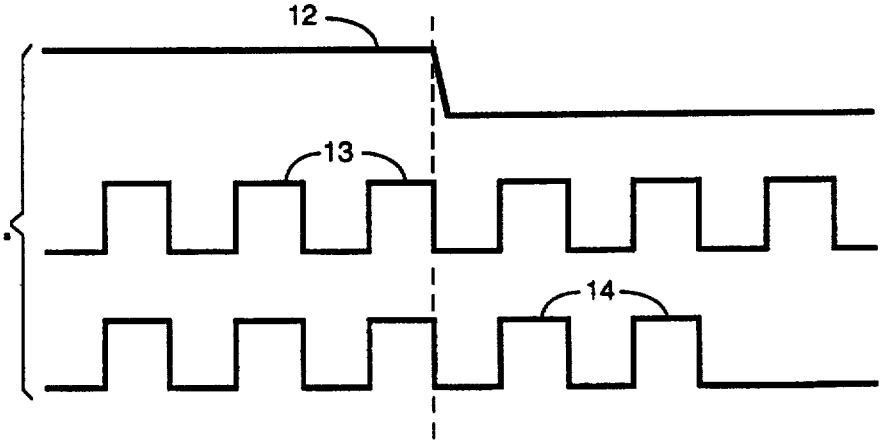

As shown in FIG. 3(*a*), if the enable logic signal level 12 is removed just prior to the falling edge of one of the output pulses 13 from the ring oscillator 1 only one further output pulse 14 is applied to the counter 2 by way of the AND gate 9, whereas if the enable logic signal level 12 is removed just after the falling edge of an output pulse 13 (FIG. 3(*b*)) then two further pulses 14 are applied to the counter 2.

In the error detecting circuit 6, while the enable logic signal level is present the select circuit 11 connects the $\overline{Q}$ output to the D input of the flip-flop 10, whereas once the enable logic signal level is removed the $\overline{Q}$output is connected to the D input. Because of this if only one output pulse 14 is passed to the counter 2 after the removal of the enable logic signal level, FIG. 3(*a*), the Q output of the flip-flop 10 switches to a one-state and remains in that state whereas if two output pulses 14 are passed to the counter 2, FIG. 3(*b*), the Q output of the flip-flop 10 switches to a one-state and back again. The latter form of Q output, indicating that a cycle of the ring oscillator 1 has just been completed and counted by the counter 2, may be used to ensure that the state or phase of the ring oscillator 1 as indicated by the state of the latches 7 may be interpreted correctly.

I claim:

1. A circuit arrangement for measuring a time interval which may be defined by transitions between logic signal levels of an input signal to said arrangement, one of which logic signal levels constitutes an enabling signal level for said circuit arrangement, including a ring oscillator comprising a plurality of stages, a like plurality of latches associated one with each of said stages, and counter means for counting complete cycles of said ring oscillator, wherein them are provided circuit means responsive to the logic signal level of said input signal and to output signal pulses from said ring oscillator to apply said output pulses to said counter means and to give an indication whether a transition in said input signal from said enabling signal level occurs before or after a predetermined transition in level in said output signal pulses from said ring oscillator.

2. A circuit arrangement in accordance with claim 1 wherein said circuit means includes synchronising means comprising first and second flip-flops through which in turn logic signal levels of said input signal are clocked by said output signal pulses from said ting oscillator, and means to detect whether said enable logic signal level is clocked once or twice from the output of said flip-flop after said transition in said input signal.

* * * * *